US011906200B2

(12) United States Patent
Cassitta et al.

(10) Patent No.: US 11,906,200 B2
(45) Date of Patent: Feb. 20, 2024

(54) VENTILATION DEVICE

(71) Applicant: RADOFF S.R.L., Bologna (IT)

(72) Inventors: Domenico Cassitta, Tempio Pausania (IT); Giovanni Piero Cassitta, Tempio Pausania (IT)

( * ) Notice: Subject to any disclaimer, the term of this patent is extended or adjusted under 35 U.S.C. 154(b) by 140 days.

(21) Appl. No.: 17/624,498

(22) PCT Filed: Jul. 2, 2020

(86) PCT No.: PCT/EP2020/068615
§ 371 (c)(1),
(2) Date: Jan. 3, 2022

(87) PCT Pub. No.: WO2021/004867
PCT Pub. Date: Jan. 14, 2021

(65) Prior Publication Data

US 2022/0357060 A1 Nov. 10, 2022

(30) Foreign Application Priority Data

Jul. 5, 2019 (IT) ..... 102019000010956

(51) Int. Cl.

| | |
|---|---|
| ***F24F 7/08*** | (2006.01) |
| ***F24F 1/03*** | (2019.01) |
| ***F24F 12/00*** | (2006.01) |
| ***F24F 13/20*** | (2006.01) |
| *F24F 110/68* | (2018.01) |

(52) U.S. Cl.
CPC ..... *F24F 7/08* (2013.01); *F24F 1/03* (2019.02); *F24F 12/006* (2013.01); *F24F 13/20* (2013.01); *F24F 2110/68* (2018.01); *F24F 2221/36* (2013.01)

(58) Field of Classification Search
None
See application file for complete search history.

(56) References Cited

U.S. PATENT DOCUMENTS

2013/0137360 A1* 5/2013 Zhong ..... F24F 13/0209 454/341

FOREIGN PATENT DOCUMENTS

EP 3045831 A1 * 7/2016 ..... F24F 12/006
EP 3045831 A1 7/2016
(Continued)

OTHER PUBLICATIONS

International Search Report for corresponding PCT/EP2020/068615, dated Sep. 28, 2020.
(Continued)

*Primary Examiner* — Juan G Flores
(74) *Attorney, Agent, or Firm* — Egbert, McDaniel & Swartz, PLLC

(57) ABSTRACT

A device for treating the air in a confined space has a first module and a second module that are telescopically coupled, in such a way that the two modules can slide one respect to the other in order to adjust to a different thickness of a wall that separates the inside from the outside. The device has a heat exchanger disposed in the first module, a first fan disposed in the first module downstream a filter to extract air from the outside to the inside, and a second fan disposed in the second module to extract air from the inside to the outside. The device also has a radon detector connected to a control unit that controls the two fans.

9 Claims, 9 Drawing Sheets

(56) References Cited

FOREIGN PATENT DOCUMENTS

| | | | |
|---|---|---|---|
| EP | 3190347 | B1 | 7/2017 |
| GB | 2194632 | A | 3/1988 |
| WO | 2019050484 | A1 | 3/2019 |

OTHER PUBLICATIONS

Written Opinion of the International Searching Authority for corresponding PCT/EP2020/068615, dated Sep. 28, 2020.

* cited by examiner

VENTILATION DEVICE

The present invention for industrial patent relates to a device used for treating the air in a confined space, and in particular for reducing the concentration of radon in a confined space.

As it is known, radon is a natural noble gas formed by the alpha decay of radium that is generated by the alpha decay of uranium, which is diffusely present in the earth's crust.

The detrimental effects of radon are produced by the polonium and the bismuth that are generated by the radioactive decay of radon. If inhaled, polonium and bismuth are deposited in the bronchial epithelium, releasing significant doses of alpha radiations that may determine the onset of lung cancer and leukemia.

The main source of radon gas is the ground, from which radon is released and dispersed in the environment. Radon accumulates in confined places and is dangerous for the human health. In particular, the basement floors of buildings may have a very high concentration of radon because of the direct penetration of radon from the ground and because they are generally poorly ventilated.

In a lesser extent, other sources of radon gas can be water and building materials, especially if of volcanic origin, such as tuff or granites. The higher the concentration of radon in a confined space, the higher the risk of contracting cancer will be. Moreover, it must be noted that at standard temperature and pressure, radon is an odorless, colorless gas and is therefore impossible to detect its presence without using a specific device.

The devices that are used to determine the concentration of radon in the air can be of active type, being based on detectors that need to be powered during the measurement, or passive type, being based on detectors that do not need to be powered. Active devices measure the concentration of radon in the space in real time, whereas passive devices measure the concentration of radon only after a measurement time. Generally, ventilation is used to avoid the accumulation of radon in a confined space.

Ventilation can be obtained in a natural way (by simply opening windows and doors) or in a forced way using ventilation devices, such as fans.

Natural ventilation is often an insufficient or ineffective solution; moreover, it involves significant costs for the heating or cooling of the confined space.

Forced ventilation is usually performed by a device that comprises:

- a first tube that comprises an inlet suitable for being disposed in a confined space in order to introduce contaminated air in the first tube, and an outlet suitable for being disposed outside the confined space in order to discharge the contaminated air outside the confined space;
- a second tube that comprises an inlet suitable for being disposed outside the confined space in order to introduce clean air in the second tube, and an outlet suitable for being disposed in the confined space in order to introduce clean air in the confined space;
- fans disposed in the first tube and in the second tube for the passage of air inside the tubes;
- a detector to detect the concentration of radon in the air in the confined space, and
- a control unit connected to the fans and to the sensors in such a way to activate the fans according to the concentration of radon in the air.

Such a device of the prior art is impaired by the fact that it is cumbersome and complicated to install. In fact, being composed of two separate tubes, two through holes must be drilled in a wall that defines the confined space, and complicated, expensive installation works are necessary. Moreover, such a device is not versatile and does not adjust to walls with different thickness.

Furthermore, being composed of two separate modules (an air extraction module and an air delivery module), the device of the prior art is impaired by low efficiency, high energy consumption and frequent maintenance operations.

EP3045831 discloses a compact ventilation system that solves the problem of maintaining a certain microclimate in closed premises and with minimum energy consumption. The device has a tubular body, in which a filter, a three-volume heat exchanger with a heater and a first fan and a second fan are mounted. Both fans operate separately: the first fan when introducing air and the second fan when discharging air from the room.

The purpose of the present invention is to overcome the drawbacks of the prior art by disclosing a device for treating the air in a confined space that is efficient and practical, with low-energy consumption.

An additional purpose is to disclose such a device for the treatment of air in a confined space that is not cumbersome, is easy to install, versatile and capable of adjusting to different wall thickness.

These purposes are achieved according to the invention with the characteristics that are listed in the appended independent claim 1.

Advantageous embodiments appear from the dependent claims.

The device according to the invention is defined by the independent claim 1.

The advantages of the device according to the invention are manifest. The provision of two fans at the two ends of the device makes it possible to simultaneously extract air from the confined space and introduce air in the confined space, without mixing the air flows.

For the sake of clarity, the description of the device according to the invention continues with reference to the attached drawings, which have a merely illustrative, not limiting value, wherein.

Figure 1:
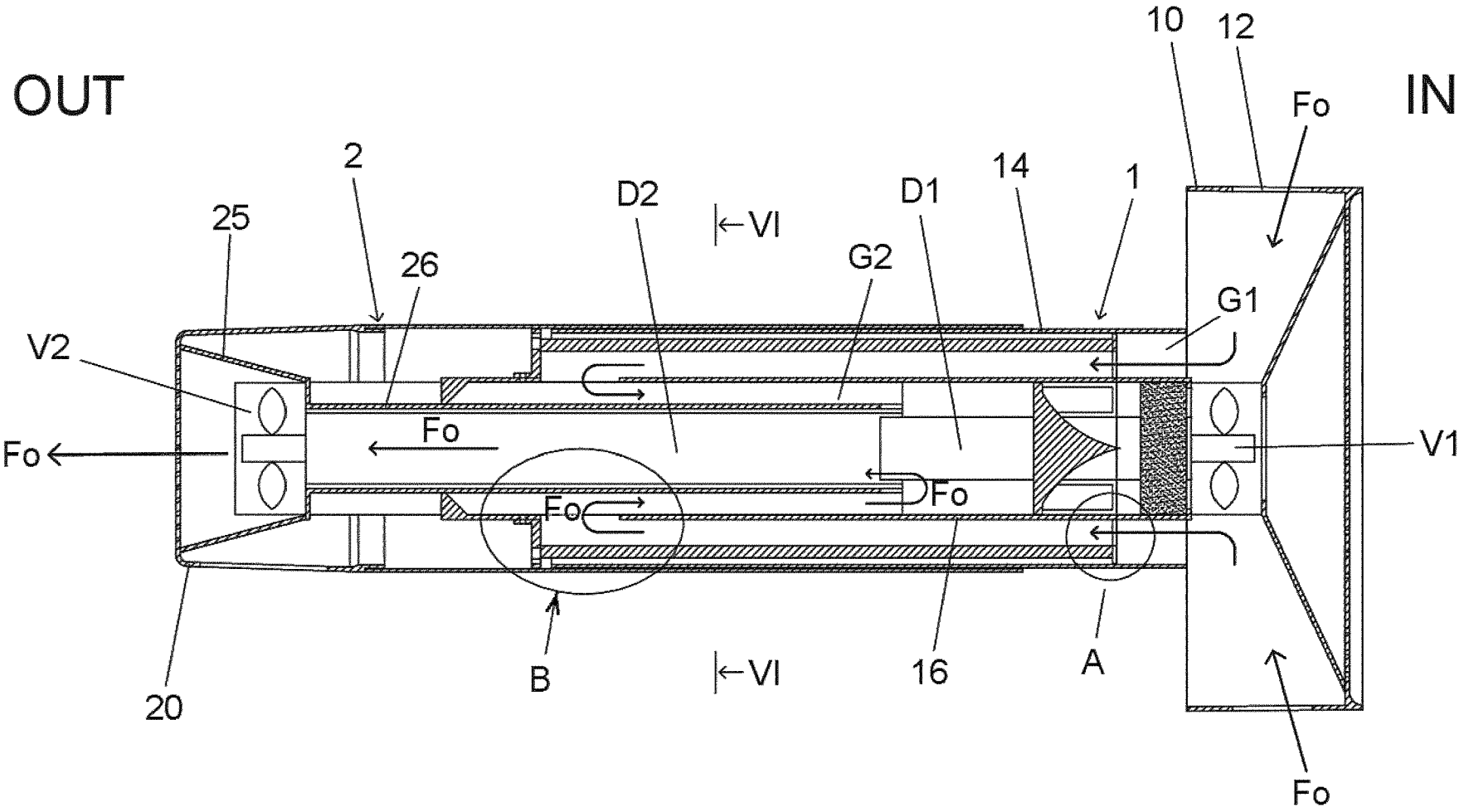
FIG. 1 is an axial sectional view of the device according to the invention, which shows an air flow from the inside to the outside.

With reference to the Figures, the device according to the invention is disclosed, which is generally indicated with reference numeral (100).

The device (100) is suitable for being installed in a wall that separates a confined indoor space from an outdoor space in order to reduce/eliminate the concentration of radon gas in the confined space.

Figure 2:
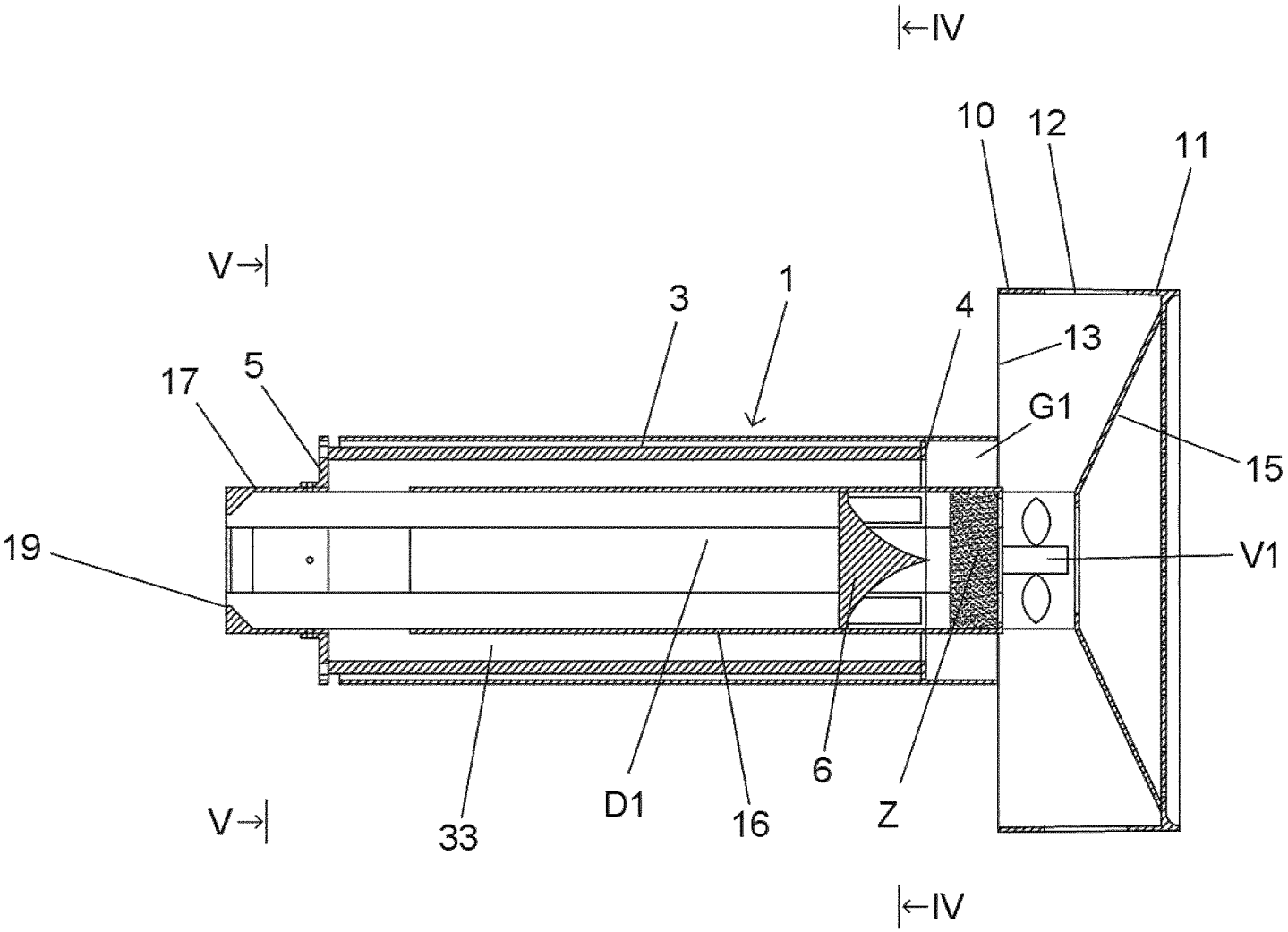
FIG. 2 is an axial sectional view of a first module of the device of FIG. 1.
Figure 3:
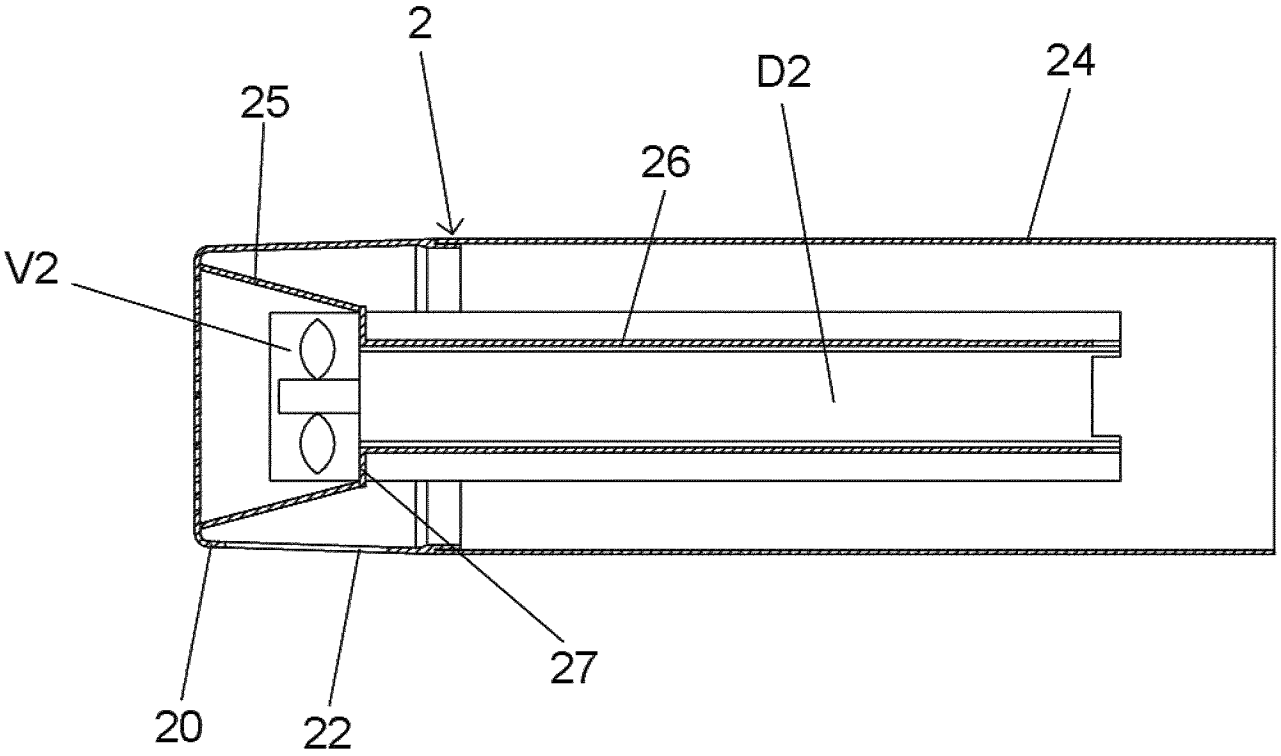
FIG. 3 is an axial sectional view of a second module of the device of FIG. 1.

With reference to FIGS. 1, 2 and 3, the device (100) comprises a first module (1) and a second module (2) with tubular shape.

The first module (1) and the second module (2) are telescopically coupled in order to slide axially, varying the axial length of the device (100) according to the thickness of the wall where the device is installed.

With reference to FIG. 2, the first module has an outlet (10) suitable for being disposed in the confined space. The outlet (10) has a substantially cylindrical shape with a lateral wall (11) provided with openings (12) that form a grille for the passage of air from the inside.

The outlet (10) has a back wall (13) joined to an external tube (14) that protrudes in rear position from the outlet. The diameter of the external tube (14) is lower than the diameter of the outlet (10) and the length of the external tube (14) is higher than the length of the outlet.

The outlet (10) has a front wall (15) with tapered shape that is joined to an internal tube (16). The internal tube (16) coaxially extends inside the outlet (10) and inside the external tube (14). The length of the internal tube (16) is lower than the length of the external tube (14).

The external tube (14) has a shank (17) that is disposed in rear position and has a lower diameter than the external tube. The shank (17) is joined to the external tube (14) by means of a back flange (5) that radially protrudes from the shank. The shank (17) has a collar (19) that protrudes inwards.

A first axial conduit (D1) is disposed in the internal tube (16) to house a first fan (V1), a filter (Z) and a conveyor (6).

The first fan (V1) is disposed at a front end of the internal tube (16) near the front wall (15) of the outlet. The first fan (V1) is configured in such a way to extract the air from the first axial conduit (D1) of the internal tube and eject the air inside from the front wall of the outlet (10).

The filter (Z) is disposed in front of the first fan (V1) and is suitable for filtering the air that is extracted by the first fan (V1) from the outside to the inside. Advantageously, the filter (Z) is an anti-particulate filter configured in such a way to filter particles with aerodynamic diameter lower than 2.5 μm. In this way, the air is filtered before being introduced in the confined space.

The conveyor (6) is disposed in front of the filter (Z). The conveyor has a tapered, conical or pyramidal shape with the point directed towards the filter (Z).

A first annular air gap (G1) is formed between the internal tube (16) and the external tube (14), wherein a heat exchanger (3) is disposed.

With reference to FIG. 3, the second module has an outlet (20) suitable for being disposed outside. The outlet (20) has a substantially cylindrical shape with a lateral wall provided with openings (22) that form a grille for the passage of air from the outside.

The outlet (20) is connected to an external tube (24) that has the same diameter as the outlet. The internal diameter of the external tube (24) of the second module is slightly higher than the external diameter of the external tube (14) of the first module, in such a way that the external tube of the first module can be inserted in the external tube of the second module and the two tubes can slide one on top of the other.

The outlet (20) of the second module has a rear end that is folded like a "U" and is joined to a shank (25) with tapered shape that is coaxially disposed inside the outlet (20). The shank (25) is connected to an internal tube (26) by means of a wall (27) that radially protrudes from the internal tube (26). The internal tube (26) coaxially extends inside the external tube (24). The length of the internal tube (26) is lower than the length of the external tube (24). A second axial conduit (D2) is disposed inside the internal tube (26).

The external diameter of the internal tube (26) of the second module is lower than the internal diameter of the internal tube (16) of the first module. In view of the above, the internal tube (26) of the second module is inserted in the internal tube (16) of the first module and a second annular air gap (G2) is formed between the two internal tubes (26, 16). The collar (19) of the shank of the first module slides on the internal tube (26) of the second module in such a way to axially center the internal tube (26) of the second module.

A second fan (V2) is disposed inside the shank (25) of the second module near the rear end of the internal tube (26). The second fan (V2) is configured in such a way to extract air from the second axial conduit (D2) of the internal tube of the second module and eject the extracted air outside from the shank (25).

Figure 6:
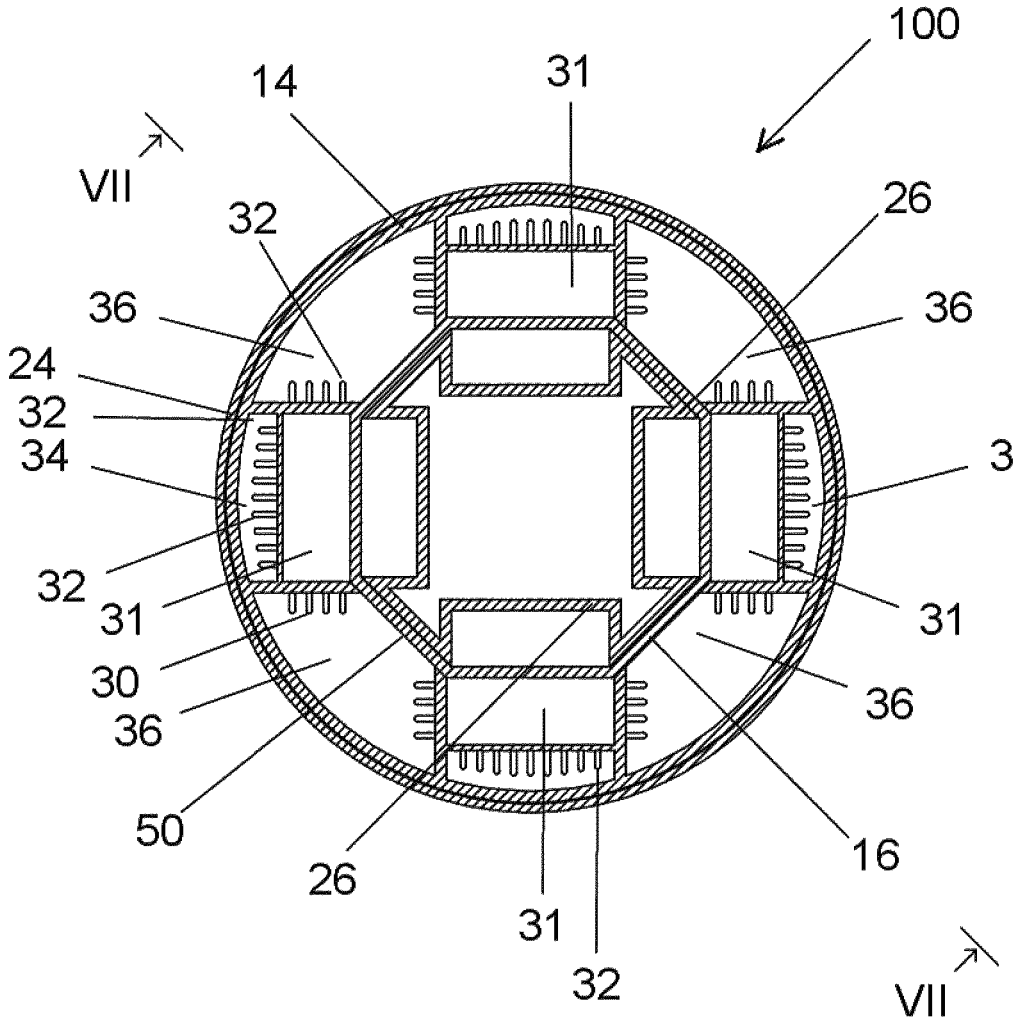
FIG. 6 is a cross-sectional view taken along the sectional plane VI-VI of FIG. 1.

With reference to FIG. 6, the heat exchanger (3) comprises a plurality of profiles (30), which are preferably made of aluminum, fixed to the internal tube (16) of the first module. Each profile (30) has a substantially U-shaped cross-section that is joined to the internal tube (16) of the first module in such a way to define first conduits (31) for the passage of air from the inside to the outside.

Each profile (30) is provided with tabs (32) that protrude outwards from the profile (30). The function of the tabs is to maximize the heat exchange of the air that flows outside the profile.

The profile (30) can be also fixed to the external tube (14) of the first module by means of extensions (33), in such a way to define an air gap (34) between the profile and the external tube (14). The tabs (32) are disposed in the air gap (34) because the air from the outside that passes in the air gap (34) must be exposed to heat exchange. In such a case, the profile (30) can have an H-shaped cross-section.

Moreover, the profiles (30) are angularly spaced in such a way that a second conduit (36) is provided between two profiles (30) for the passage of air from the outside to the inside.

The internal tube (16) of the first module has an octagonal shape in cross-section. In this way, the heat exchanger (3) comprises four profiles (30) disposed on four non-adjacent sides of the internal tube (16) and angularly equally spaced by 90°. Therefore, four first conduits (31) are provided for the passage of air from the inside to the outside and four second conduits (36) are provided for the passage of air from the outside to the inside.

With reference to FIG. 2, the heat exchanger (3) is disposed between the back flange (5) and a front flange (4). The front flange (4) and the back flange (5) act as air distributors.

Figure 1B:
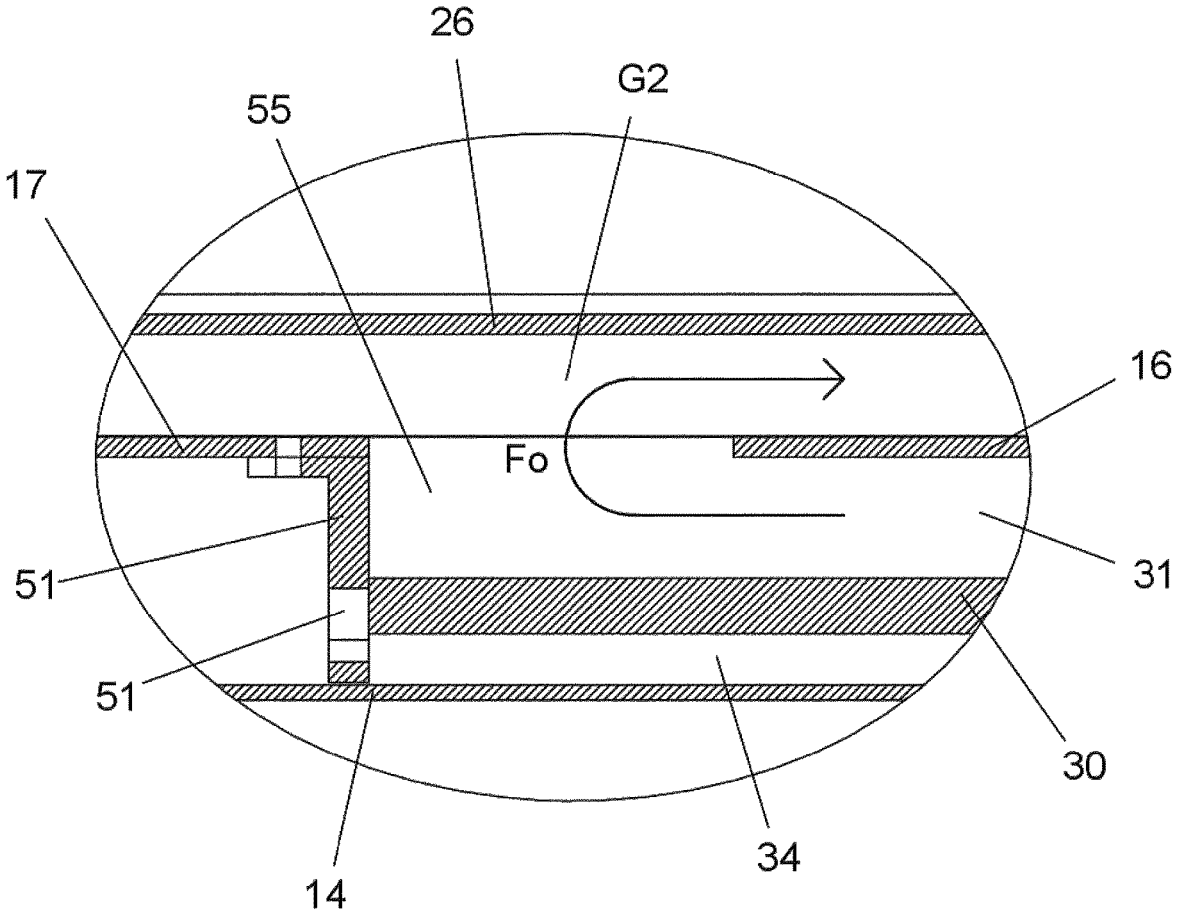
FIGS. 1A and 1B are two enlarged views of two details of FIG. 1, which are respectively enclosed in the circles A and B of FIG. 1.
Figure 1A:
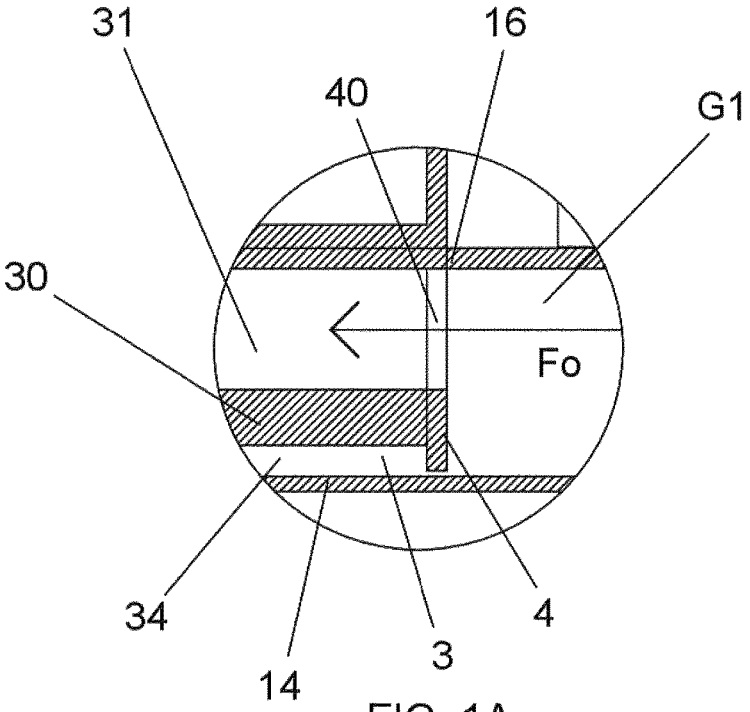
Figure 4:
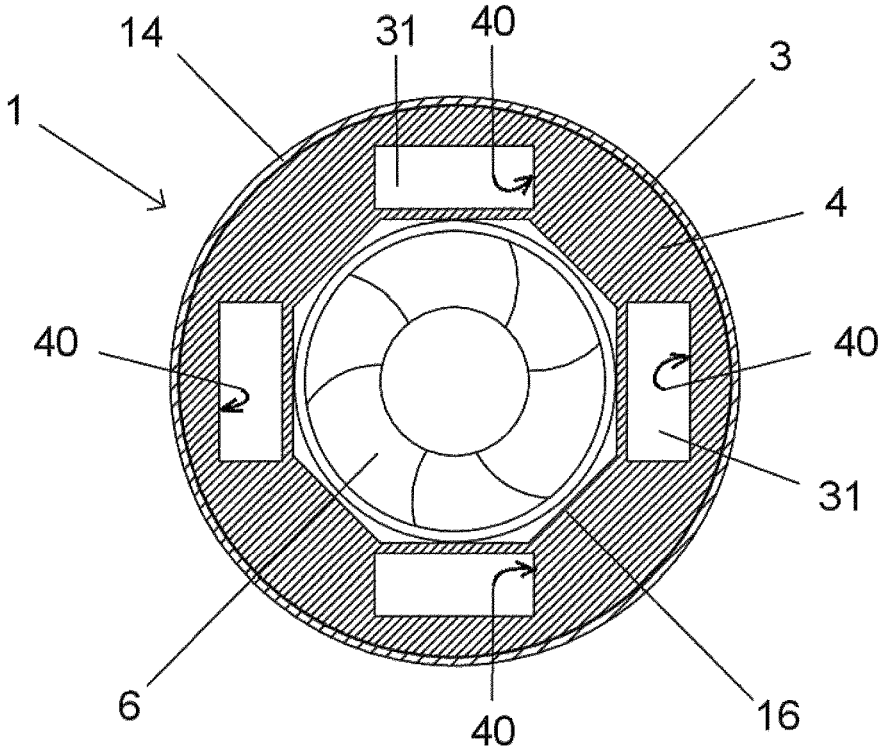
FIGS. 4 and 5 are two cross-sectional views taken along the planes IV-IV and V-V of FIG. 2.
Figure 7:
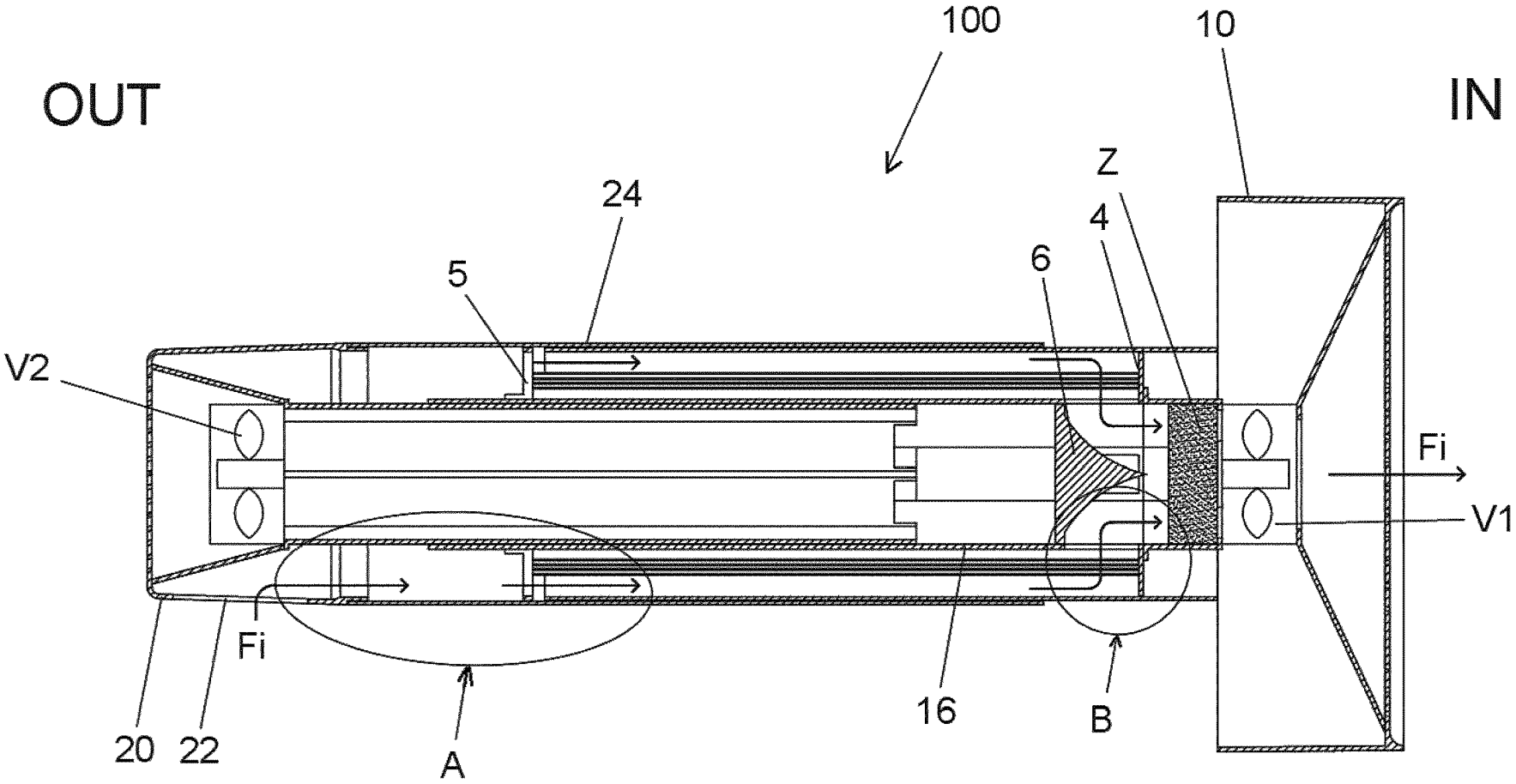
FIG. 7 is an axial view taken along the sectional plane VII-VII of FIG. 6, which shows the air flow from the outside to the inside.
Figure 7A:
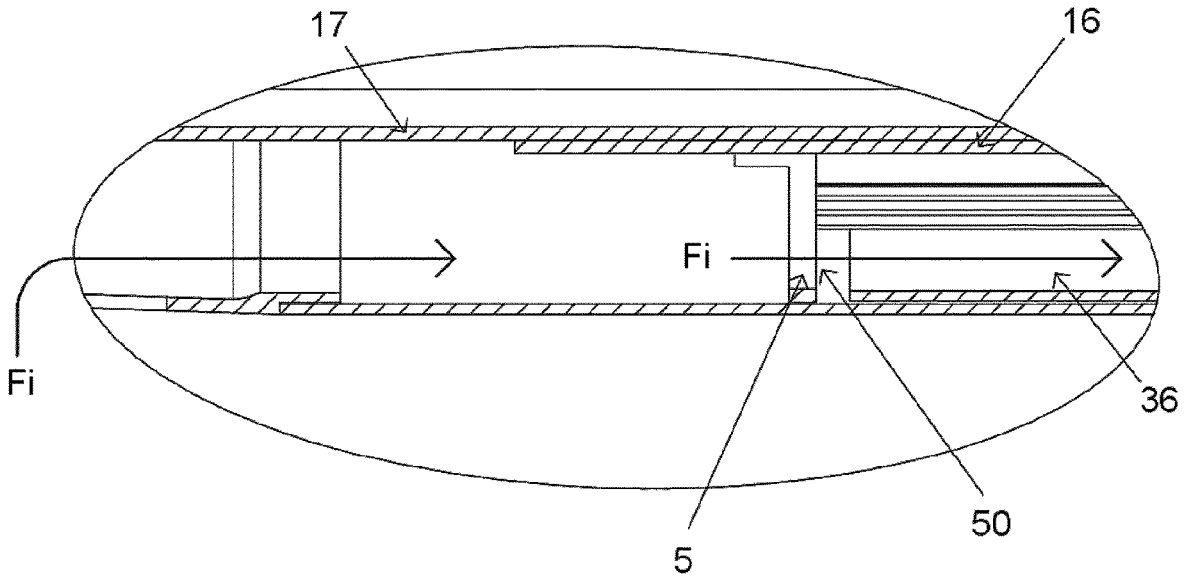
FIGS. 7A and 7B are two enlarged views of two details of FIG. 7, which are respectively enclosed in the circles A and B of FIG. 7.

With reference to FIGS. 4, 1A and 7A, the front flange (4) is provided with openings (40) in correspondence of the first conduits (31) of the heat exchanger and obstructs the second conduits (36) and the air gaps (34) of the heat exchanger. In view of the above, the air from the inside that hits the front flange (4) is exclusively introduced in the first conduits (31) of the heat exchanger.

Figure 5:
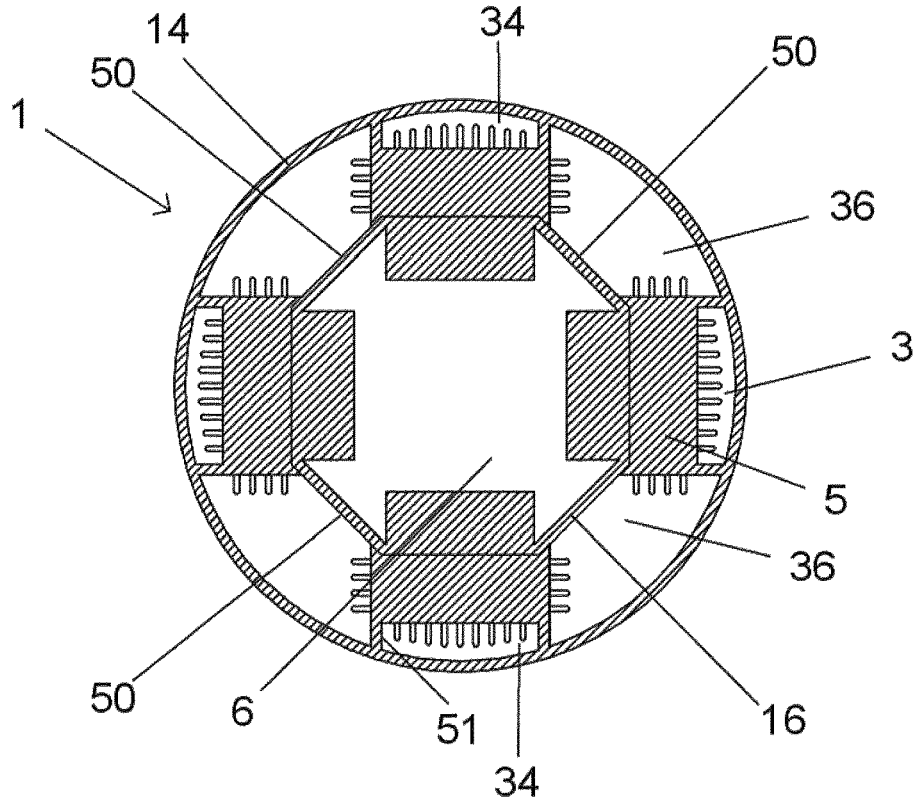
Figure 7B:
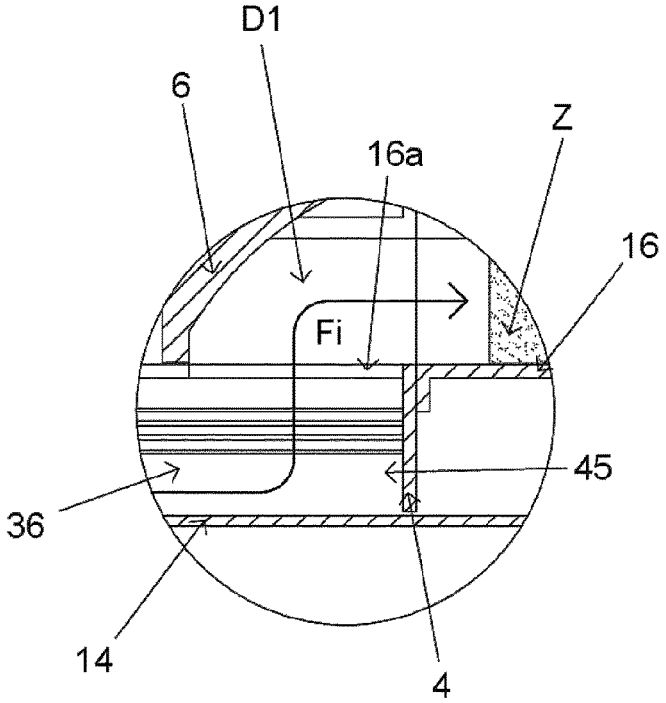

With reference to FIGS. 5, 1B and 7B, the back flange (5) is provided with openings (50, 51) in correspondence of the second conduits (36) and of the air gaps (34) of the heat exchanger and obstructs only the first conduits (31) of the heat exchanger. In view of the above, the air from the outside that hits the back flange (5) is introduced in the second conduits (33) and in the air gaps (34) of the heat exchanger and is not introduced in the first conduits (31).

With reference to FIG. 1B, it must be noted that the back end of the internal tube (16) of the first module is distant from the shank (17). Communication conduits (55) are obtained in the back flange (5) to put the first conduits (31) of the heat exchanger in communication with the second air gap (G2) between the internal tube (16) of the first module and the internal tube (26) of the second module.

With reference to FIG. 7B, openings (16*a*) are obtained in the internal tube (16) of the first module, in correspondence of the front flange (4) between the filter (Z) and the conveyor (6). Communication conduits (45) are obtained in the front flange (4) to put in communication the second conduits (36) of the heat exchanger with the openings (16*a*) of the internal tube of the first module in order to let the air from the outside flow towards the first axial conduit (D1) between the conveyor (6) and the filter (Z), in such a way that the conveyor (6) conveys the air towards the filter (Z).

FIGS. 1, 1A and 1B describe the air flow from the inside to the outside that is obtained by actuating the second fan (V2). Such an air flow is illustrated with arrows and indicated as Fo.

The air from the inside is introduced in the openings (12) of the outlet (10) of the first module and reaches the first air gap (G1) between the internal tube (16) and the external tube (14) of the first module, hitting the front flange (4). Then, the air is introduced in the openings (40) of the front flange, flows in the first conduits (31) of the heat exchanger, passes through the communication conduits (55) of the back flange (5) and is introduced in the second air gap (G2) between the internal tube (16) of the first module and the internal tube (26) of the second module, following an S-shaped winding trajectory to reach the first axial conduit (D1) of the first module. The conveyor (6) prevents the air from going towards the filter (Z).

The air that is contained in the first axial conduit (D1) of the first module is extracted in the second axial conduit (D2) of the second module from the second fan (V2) and is discharged outside from the shank (25).

FIGS. 7, 7A and 7B describe the air flow from the outside to the inside that is obtained by actuating the first fan (V1). Such an air flow is illustrated with arrows and indicated as Fi.

The air from the outside is introduced in the openings (22) of the outlet (20) of the second module and hits the back flange (5). Then, the air is introduced in the openings (50, 51) of the back flange and flows in the second conduits (36) and in the air gaps (34) of the heat exchanger.

The air that flows in the second conduits (36) of the heat exchanger reaches the communication conduits (45) of the front flange and passes through the openings (16*a*) of the internal tube (16) of the first module, it being introduced in the first axial conduit (D1) of the first module, between the conveyor (6) and the filter (Z). The conveyor (6) conveys the air towards the filter (Z).

The air that is contained in the first axial conduit (D1) of the first module is extracted by the first fan (V1) and is introduced inside, it being discharged from the back wall of the outlet (10) of the first module.

It must be noted that the air flow (Fi) from the outside to the inside is a countercurrent flow with respect to the air flow (Fo) from the inside to the outside. In this way, the heat exchanger (3) operates with maximum efficiency, permitting a thermal exchange between the air from the inside and the air from the outside.

The function of the first fan (V1) is to introduce an air flow (Fi) from the outside inside the confined space. The function of the second fan (V2) is to extract an air flow (Fo) from the confined space and discharge the air flow (Fo) outside. The trajectories followed by the two air flows are shown in FIGS. 1 and 7. When the fans (V1) and (V2) are in operation, the device (100) simultaneously produces the two air flows (Fi, Fo) that are always separated.

It must be considered that the front flange (4) and the back flange (5) act as air distributors. The front flange (4) conveys the air flow (Fo) inside the profiles (30) of the heat exchanger; whereas the back flange (5) conveys the air flow (Fi) outside the profiles (30).

The function of the heat exchanger (3) is to absorb heat from the air flow (Fo) from the inside and release heat to the air flow (Fi) from the outside. By means of the heat exchange (3), the air that is introduced in the confined space does not determine any sudden temperature change in the confined space.

Figure 8:
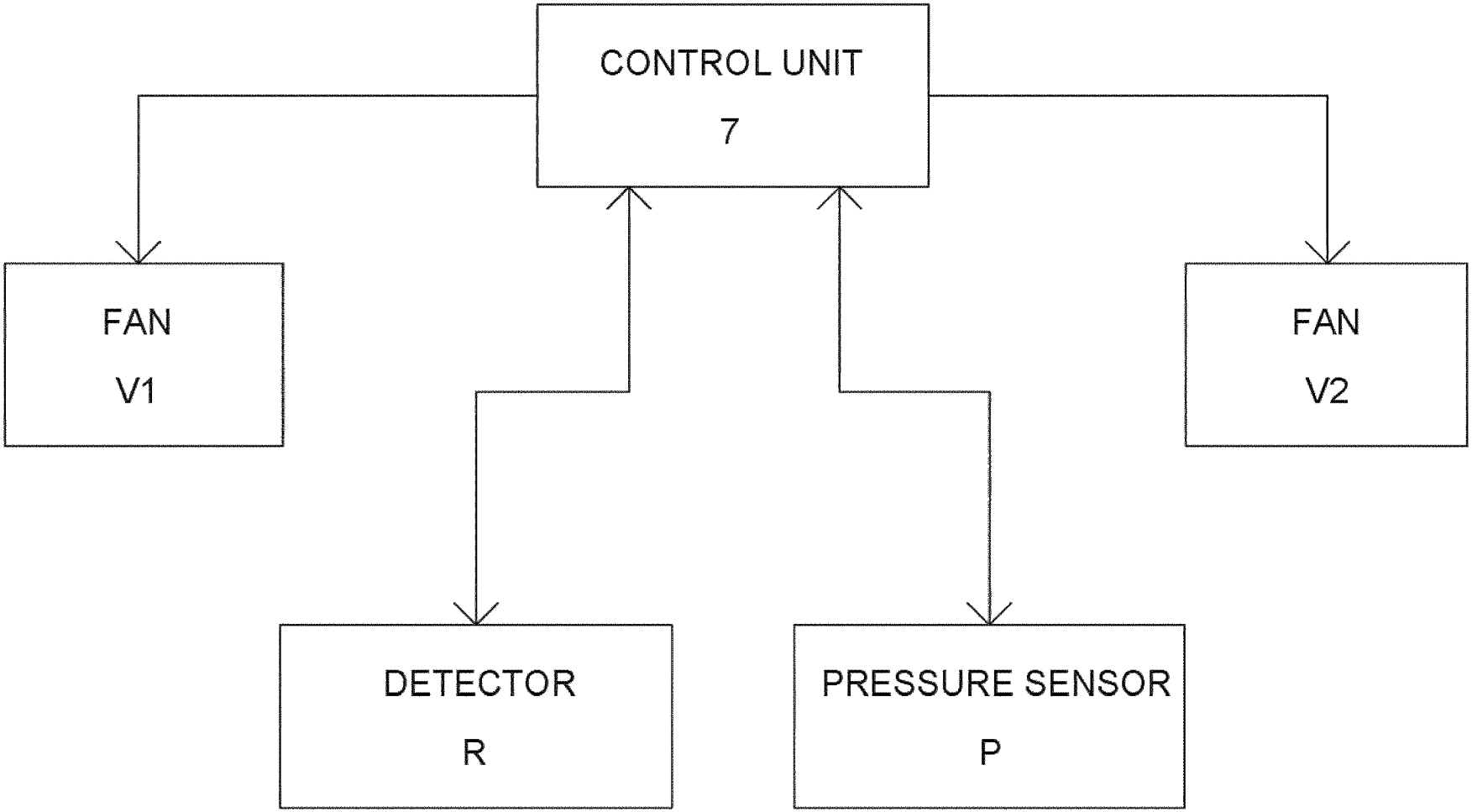
FIG. 8 is a block diagram that shows the electrical connections of the device of the invention.

With reference to FIG. 8, the device (100) comprises a radon detector (R) and a control unit (7) connected to the radon detector (R). The radon detector (R) is independent and separated from the air extraction/delivery system. In view of the above, the radon detector (R) can be installed anywhere in the confined space to detect the presence of radon gas in the confined space.

The radon detector (R) may be any active measurement device, such as a scintillation cell, a solid state detector or an ionization chamber. The use of an active measurement device provides the real time monitoring of the concentration of radon gas in the confined space.

The control unit (7) is configured in such a way to receive information on the concentration of radon gas in the confined space from the radon detector (R). The control unit (7) comprises a comparator (70) to compare the concentration of radon gas detected by the radon detector (R) with a threshold value stored in the comparator (70).

The control unit (7) is connected to the fans (V1, V2) that are actuated according to the concentration of radon gas detected by the radon detector (R).

The control unit (7) is configured in such a way to simultaneously activate and move the fans (V1, V2) when the concentration of radon is higher than the threshold value.

More precisely, the control unit (7) is configured in such a way to activate the second fan (V2) in order to extract the air from the inside, and to activate the first fan (V1) in order to introduce air in the confined space when the radon detector (R) detects a concentration of radon gas in the confined space that is higher than the threshold value.

On the contrary, the control unit (7) deactivates the fans (V1, V2) when the radon detector (R) detects a concentration of radon gas in the confined space that is lower than or equal to the threshold value.

The control unit (7) is configured in such a way to activate the fans (V1, V2) at a variable revolutional speed according to the incoming/outgoing air flow to be provided in order to reduce the initial concentration of radon gas. In any case, the control unit (7) is configured in such a way to activate the first fan (V1) at a higher revolutional speed than the second fan (V2). In view of the above, the air flow (Fi) provided by the first fan (V1) from the outside to the inside is higher than the air flow (Fi) provided by the second fan (V2) from the inside to the outside.

The control unit (7) is configured in such a way to adjust the speed of the first fan (V1) in order to increase the pressure in the confined space.

The introduction in the confined space of an air flow higher than the air flow extracted from the confined space determines a pressure increase in the confined space that limits the rise of radon gas from the ground (the so-called "chimney effect") and prevents its accumulation in the confined space.

Advantageously, the device (100) comprises a pressure sensor (P) connected to the control unit (7) in such a way to send information on a pressure value of the air in the confined space to the control unit (7).

Optionally, the device (100) comprises other sensors, such as a humidity sensor, a temperature sensor and a PM10 and PM2.5 particulate sensor (not shown in the figures).

When the radon detector (R) detects a concentration of radon gas that is higher than the threshold value stored in the comparator (70) of the control unit (7), the following actions are simultaneously performed:

The first fan (V1) is activated to produce an air flow (Fi) from the outside to the inside.

The first fan (V1) extracts the air in correspondence of the openings (22) of the outlet of the second tube.

Because of the provision of the back flange (5), the air flow (Fi) flows in the external portion of the profiles (30) of the heat exchanger (3), heating the profiles (30).

The air flow (Fi) flows in the first axial conduit (D1) of the first module through the communication conduits (45) of the front flange (4) and is conveyed towards the filter (Z) by means of the conveyor (6).

The first fan (V1) introduces the air flow (Fi) in the confined space through the front wall of the outlet (10) of the first module.

The second fan (V2) is activated to produce an air flow (Fo) from the inside to the outside, with Fo<Fi.

The second fan (V2) extracts the air in correspondence of the openings (12) of the outlet of the first module.

Because of the provision of the front flange (4), the air flow (Fo) flows in the first conduits (31) of the profiles (30) of the heat exchanger (3), releasing the heat.

The air flow (Fo) is conveyed in the second air gap (G2) between the internal tube (16) of the first module and the internal tube (26) of the second module through the communication conduits (55) of the back flange and is conveyed in the second axial conduit (D2) of the internal tube of the second module towards the second fan (V2).

The second fan (V2) releases the air flow (Fo) outside through the shank (25) of the outlet of the second module.

The two air flows (Fo and Fi) are never crossed during the operation of the fans (V1, V2).

The control unit (7) turns off the fans (V1, V2) when the radon detector (R) detects a concentration of radon gas lower than or equal to the threshold value stored in the comparator (70) of the control unit (7).

During the introduction of the air in the inside from the outside, the speed of the first fan (V1) is adjusted in such a way to increase the internal pressure. In fact, high pressure values hinder the formation of the radon gas.

The device (100) is more compact than a device of the prior art because it comprises two modules (1, 2) that are coaxially disposed one inside the other, instead of two separate modules, thus simplifying the installation compared to the prior art. An innovative aspect of the device is represented by the provision of the particulate filter (Z) that improves the salubrity of the confined space and avoids the formation of a cluster between particulates and radon particles, which is detrimental for the human health.

The invention claimed is:

1. An apparatus for heating air in a confined space, the apparatus comprising:

a first module having an outlet adapted to be disposed in the confined spaced, said first module having an external tube that protrudes rearwardly from the outlet of said first module, said first module having an internal tube axially disposed inside the outlet and inside the external tube, the internal tube defining a first axial conduit, the outlet of said first module having openings adapted to introduce air toward a first air gap between the internal tube and the external tube of said first module;

a second module having an outlet adapted to be disposed outside the confined space, said second module having an external tube that protrudes frontally from the outlet of said second module, said second module having a shank disposed inside, the outlet of said second module, said second module having an internal tube that protrudes frontally from the shank, the internal tube of said second module axially disposed inside the external tube of said second module and defines a second axial conduit, the outlet of said second module having openings adapted to introduce air toward a second air gap between the internal tube of said second module and the external tube of said second module;

a first fan disposed at a front end of the first axial conduit of the internal tube of said first module so as to extract air from the first axial conduit and to introduce air to the confined space;

a second fan disposed in the shank of said second module so as to extract air from the second axial conduit of the internal tube of said second module and to discharge air exteriorly;

a heat exchanger disposed in the first air gap of said first module, said heat exchanger having first conduits for a passage of air interiorly to exteriorly and having second conduits for a passage of air exteriorly to interiorly;

a filter disposed in the first axial conduit of said first module in front of said first fan so as to filter air introduced to the confined space;

a radon detector adapted to detect a presence of radon in the confined space; and a control unit connected to said radon detector so as to receive information as to the presence of radon in the confined space, said control unit comprising a comparator that compares concentration of radon detected by said radon detector with a threshold value stored in the comparator, said control unit being connected to said first fan and to said second fan so as to activate said first fan and said second fan when said radon detector detects the concentration of radon in the confined space that is higher than the threshold value, wherein said first module and said second module are telescopically coupled, wherein the external tube of said second module is slidable on the external tube of said first module, the internal tube of said second module is disposed inside the internal tube of said second module so as to define the second air gap such that said first module can slide with respect to said second, module in order to adjust a thickness of a wall that separates the inside from the outside.

2. The apparatus of claim 1, further comprising:

a conveyor disposed in the first axial conduit in front of said filter, said conveyor having a tapered shape with a point directed towards said filter in order to convey the air from the outside towards said filter.

3. The apparatus of claim 1, wherein said first module comprises a shank that protrudes in rearwardly from the external tube of said second module and has a collar that protrudes in a lower position in order to slide on the internal tube of said second module.

4. The apparatus of claim 1, wherein said heat exchanger comprises a plurality of profiles disposed on the internal tube of said first module wherein the first conduits of said heat exchanger are defined, the plurality of profiles having with outward-protruding tabs, wherein the second conduits of said heat exchanger are outside the profiles.

5. The apparatus of claim 4, wherein the internal tube of said first module has an octagonal section, said heat exchanger having four first conduits on four non-adjacent sides of the internal tube of said first module and four second conduits disposed at a common angular distance on additional four non-adjacent sides of the internal tube of said first module.

6. The apparatus of claim 1, further comprising:

a front flange and a hack flange respectively disposed at a front end and at a back end of said heat exchanger, said front flange allowing an air flow towards the first conduits and obstructing an air flow towards the second conduits of said heat exchangers, said back flange allowing an air flow towards the second conduits and obstructing an air flow towards the first conduits of said heat exchanger.

7. The apparatus of claim 6, wherein said back flange has communication conduits that put the first conduits of said heat exchanger in communication with the second air gap between the internal tube of said first module and the external tube of said second module, wherein said front flange has communication conduits that put the second conduits of said heat exchanger in communication with openings of the internal tube of said first module in order to introduce air in the first axial conduit of said first.

8. The apparatus of claim 1, further comprising:

a pressure sensor connected to said control unit in order to send information on a pressure value of said air in the confined space, said control unit being configured in such a way to adjust a speed of said first fan to be higher than a speed of said second fan in order to increase the pressure in the confined space.

9. The apparatus of claim 1, further comprising as humidity sensor, a thermal sensor, a PM10 pressure sensor and a PM2.5 particulate sensor.

* * * * *